United States Patent [19]

Ammon

[11] 4,127,935

[45] * Dec. 5, 1978

[54] METHOD FOR ASSEMBLY OF ELECTRICAL CONNECTORS

[75] Inventor: John P. Ammon, Dallas, Tex.

[73] Assignee: Elfab Corporation, Dallas, Tex.

[ * ] Notice: The portion of the term of this patent subsequent to Aug. 17, 1993, has been disclaimed.

[21] Appl. No.: 875,535

[22] Filed: Feb. 6, 1978

Related U.S. Application Data

[60] Continuation of Ser. No. 659,764, Feb. 20, 1976, abandoned, which is a division of Ser. No. 534,442, Dec. 19, 1974, abandoned.

[51] Int. Cl.[2] ..... H01R 9/16; H01R 13/04; H01R 43/00

[52] U.S. Cl. ..... 29/629

[58] Field of Search ..... 339/17 R, 17 C, 17 LC, 339/220 R, 220 T, 221 R, 221 M; 29/626, 629, 630 R, 630 D

[56] References Cited

U.S. PATENT DOCUMENTS

| | | | |
|---|---|---|---|
| 3,320,572 | 5/1967 | Schwartz | 339/17 LC |
| 3,530,422 | 9/1970 | Goodman | 339/220 T |
| 3,780,433 | 12/1973 | Lynch | 29/629 X |
| 3,807,045 | 4/1974 | Bennett et al. | 29/629 |
| 3,864,000 | 2/1975 | Coller et al. | 339/17 LC X |
| 3,975,072 | 8/1976 | Ammon | 29/626 X |

*Primary Examiner*—Francis S. Husar
*Assistant Examiner*—Gus T. Hampilos
*Attorney, Agent, or Firm*—Crisman & Moore

[57] ABSTRACT

Contacts and receiving sleeves within a connector insulator are sized to permit the contacts to be inserted into the sleeves of the insulator and lightly held in position. Each contact includes a press fit shoulder portion which protrudes from the bottom of the insulator and is adapted for press fitting into a receiving aperture formed in a mounting substrate. After the contacts are press fitted into the mounting substrate, a flat blade-like contact portion protrudes from the top of the insulator for electrical engagement with a female contact (not disclosed) while a contact tail portion extends below the substrate for wire wrap termination. The assembled connector configuration permits removal of the insulator by lifting it from around the contacts which it lightly engages. Further, with the insulator in place, any individual contact may be removed from both the insulator and the substrate for replacement in the event of damage.

A partial connector assembly, comprising an insulator having contacts lightly held therein, may be readily shipped to a remote location and there installed in a mounting substrate by press fitting the shoulder portions of the contacts protruding from the bottom of the insulator into receiving apertures in the substrate.

5 Claims, 11 Drawing Figures

METHOD FOR ASSEMBLY OF ELECTRICAL CONNECTORS

This is a continuation of application Ser. No. 659,764, filed Feb. 20, 1976, which is a division of prior executed application Ser. No. 534,442, filed Dec. 19, 1974, now abandonned.

BACKGROUND OF THE INVENTION

The invention relates to an electrical connector, and more particularly, to an electrical connector having contacts lightly held within sleeves formed in an insulator and rigidly mounted by press fitting the contacts into receiving apertures formed in a substrate.

Certain prior art connectors have been assembled by very tightly press fitting or molding a contact into a receiving block of insulative material which forms a structural member to support the contacts and hold them rigidly within the insulative body. The prior art connector, having contacts rigidly fixed within the insulator, may then be mounted by bolting the insulator to a pair of spaced parallel rails, or by dropping the contact tails into holes in a mounting substrate and soldering them. Problems arise in substrate mounted connectors of this type in that since the insulator forms a structural member which supports the contacts, the insulator cannot be removed after the connector is mounted to the substrate. Further, it is virtually impossible to remove individual ones of the contacts from within the insulator and/or the mounting substrate in the event one of the contacts is damaged.

The prior art techniques for assembly of these connectors are also relatively slow because of the large forces required to tightly press fit, and thereby rigidly mount, each individual contact into its receiving sleeve within the insulator. The improved connector and method of the present invention overcome certain of these disadvantages by providing for simultaneous insertion of rows of contacts held together on strips into receiving sleeves which hold them lightly in position within the insulator. Simultaneous contact insertion greatly speeds the connector assembly process and the light insulator/contact holding force enables insertion of the contacts into the insulator by hand eliminating the need for mechanical pressing apparatus. In addition, the fact that the contacts are only lightly held within the insulator sleeves provides the further advantage of repairability by permitting ready removal and replacement of individual contacts from within the insulator.

SUMMARY OF THE INVENTION

The invention relates to an electrical connector and method of assembly which includes contact terminals lightly held within sleeves in an insulator and which are adapted for rigid mounting into receiving apertures in a mounting substrate. More particularly, the invention involves an electrical connector wherein a plurality of contacts are simultaneously inserted in rows into loosely fitting sleeves within an insulative body. The contacts include portions extending from the lower surface of the insulative body which portions are adapted for press fitting into receiving apertures in a mounting substrate wherein the contacts are held rigid and motionless. The mounting substrate forms the structural support for the connector. The insulative housing of the mounted connector may then be removed from around the lightly engaged contacts and the contacts may also be individually removed from the mounting substrate for ease of repairability. A new insulator, or the same insulator removed, may then be replaced over the contacts.

Another aspect of the invention involves an electrical connector adapted for structural mounting to a substrate having contact receiving holes formed therein. Included is an insulative block having a plurality of sleeves formed through it. The sleeves are spaced for subsequent alignment with apertures in a mounting substrate. Contacts extend through each of the sleeves in the insulative block. The contacts are held in position by frictional engagement with the inner walls of the sleeves to permit relative movement therebetween so that an insertion tool can further position the contacts relative to both the insulator and the mounting substrate.

BRIEF DESCRIPTION OF THE DRAWINGS

For a more complete understanding of the present invention and for further objects and advantages thereof, reference may now be had to the following description taken into conjunction with the accompanying drawings, in which.

DETAILED DESCRIPTION

Figure 1:
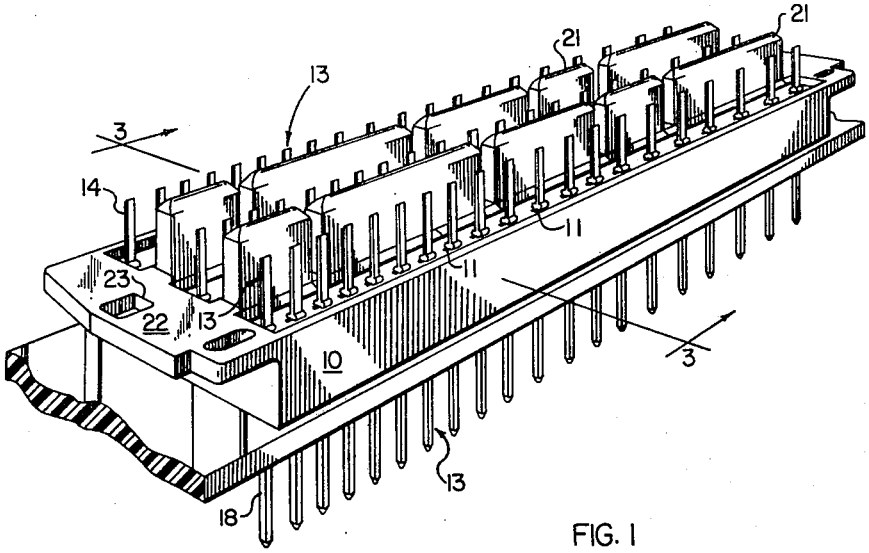
FIG. 1 is a perspective view of an electrical connector constructed in accordance with the invention.
Figure 2:
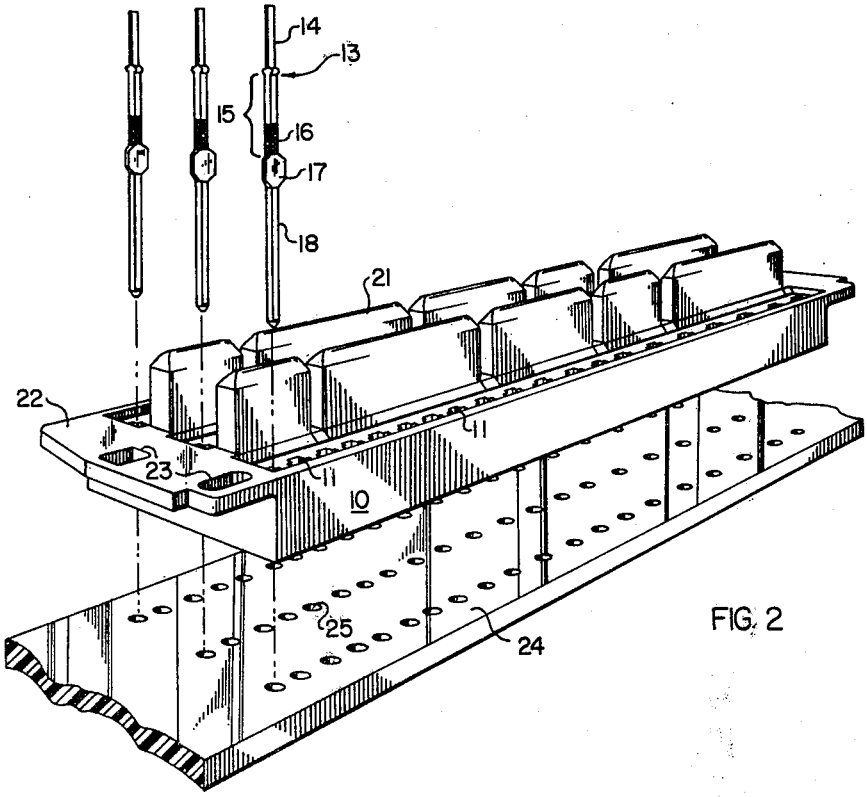
FIG. 2 is an exploded perspective view of part of the electrical connector shown in FIG. 1.
Figure 3:
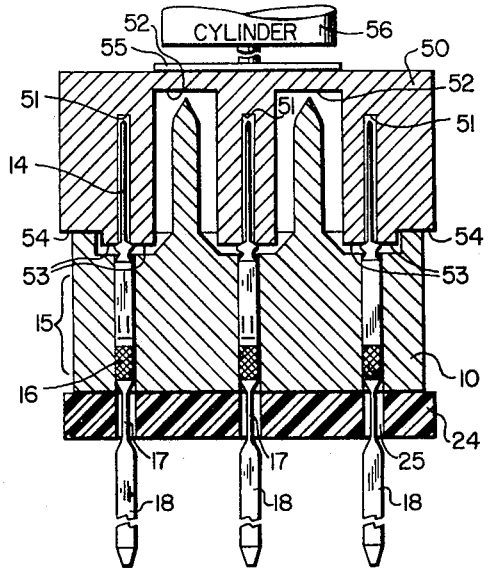
FIG. 3 is a cross-sectional view taken about the lines 3—3 of FIG. 1 and further includes a partial cross-sectional view of an insertion and positioning tool.

Referring first to FIGS. 1 and 2, there is shown a perspective view of an electrical connector constructed in accordance with the present invention. The connector includes an insulator 10 having a plurality of contact receiving sleeves 11 formed therethrough. Each of the sleeves 11 is sized to receive a contact 13. The configuration of the contacts illustrated is best shown in FIGS. 2 and 3. The contacts 13 are of the straight post type having a generally flat upper blade portion 14, an intermediate portion 15 which includes a roughened or knurled area 16, a widened press fitting shank portion 17, and a generally square tail section 18. The contact blade portion 14 is preferably plated for electrical interengagement with a gripping female contact (not shown). As is shown, the contact shank portion 17 is somewhat wider, in one direction, than the rest of the contact. Purely by way of example, in a 25 mils × 25 mils square contact post the shank portion may be on the order of 25 mils × 40 mils and in either a 40 or 45 mils square post contact the shank region may be on the order of 21 mils × 62 mils or 40 mils × 55 mils.

Figure 4:
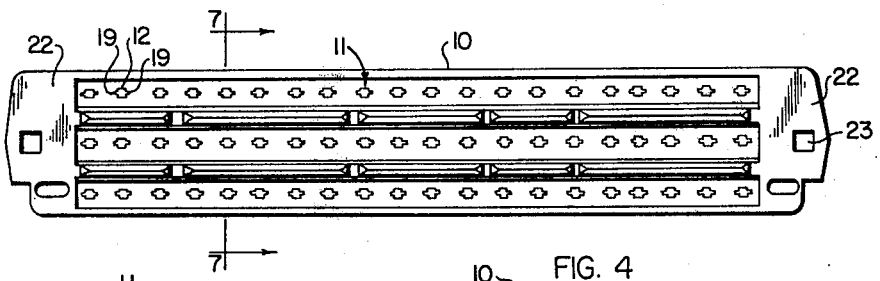
FIG. 4 is a top view of a connector insulator used in the present invention.
Figure 5:
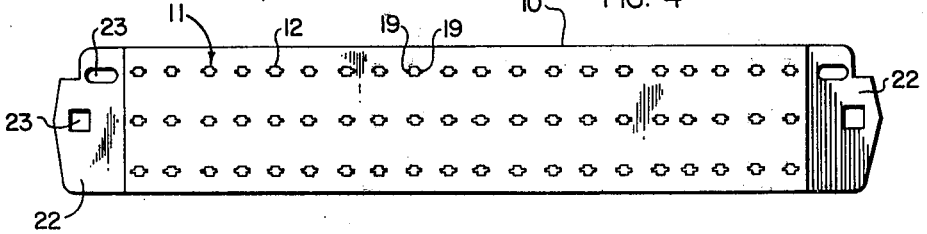
FIG. 5 is a bottom view of the insulator shown in FIG. 4.
Figure 7:
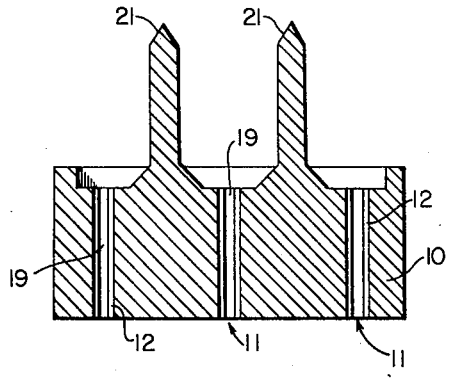
FIG. 7 is a cross-sectional view taken about the lines 7—7 of FIG. 4.

As best shown in FIGS. 4, 5 and 7, the contact receiving sleeves 11 include a generally square opening 12 having longitudinally extending rectangular slots 19 formed in opposed side walls thereof to allow clear passage of the widened press fitting shank regions 17 through the sleeves 11. The contacts 13 are lightly held within the sleeves 11 of the insulator with a retention force of one to two pounds, due primarily to slight frictional interference between the knurled regions 16 and the side walls of the openings 12 within the sleeves 11.

Referring again to FIGS. 1 and 2, the insulative body 10 is preferably molded from a plastic material such as a polycarbonate. The insulator includes two spaced parallel rows of upstanding projections 21 which are adapted for mating with corresponding receiving slots in a female connector insulator (not shown). The female connector (not shown) includes a plurality of gripping contacts each one of which will receive one of the blade portions 14 of the contacts 13. The female part is keyed into position by engagement with the polarizing projections 21 and the spaces therebetween. Of course, other configurations of male/female insulator polarization may be employed. The insulator 10 also includes flared end portions 22 having openings 23 formed therein. The insulator 10 and the contacts 13 of the present connector are structurally attached to a mounting substrate 24, such as a printed circuit board. The mounting substrate includes a plurality of rows of preferably circular apertures 25 which are spaced for alignment with the sleeves 11 formed in the insulator 10 when the insulator is positioned above the substrate.

As mentioned above, it is preferable to insert the contacts 13 into the insulator sleeves 11 with a plurality of contacts joined together on a common support strip. There are two contact support configurations which are preferred for this aspect of the assembly operation. The particular configuration employed may depend upon the manner in which the contacts are formed.

Figure 8:
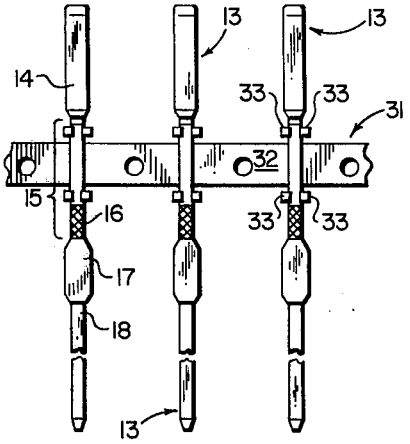
FIG. 8 shows a front view of a plurality of contacts used in connection with the invention which are strips mounted on a bandolier for insertion in accordance with the teachings of the invention.
Figure 9:
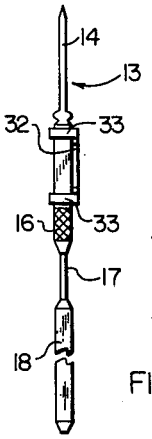
FIG. 9 is an end view of the strip of contacts shown in FIG. 8.

First, as shown in FIGS. 8 and 9, the straight post contacts 13 used herein may be formed and mounted on a bandolier 31 which comprises a thin ribbon of material 32 extending transversely to the axes of the contacts 13. Bandolier mounting is especially useful where the contacts are sequentially formed from a continuous square wire and individually attached to a continuous bandolier which is incrementally indexed at right angles to the formed wire. Stamping the contacts 13 from square wire leaves certain contact regions which remain square in cross section, e.g., the intermediate portion 15 and the tail section 18, and produces certain contact regions which are wider and thinner than the wire, e.g., the blade portion 14 and the shank portion 17.

As shown in FIGS. 8 and 9, each contact 13 is held to the ribbon 32 a spaced distance from adjacent contacts by a plurality of fragile tines 33 which are bent around the contact body to grip it and hold it in position. The contacts 13 are spaced from one another the same distance as that between each sleeve 11 in the insulator 10. In assembly, the desired number of contacts in a row is selected and the bandolier ribbon 32 is cut to separate the row of contacts on a strip from the rest. The contacts 13 are all simultaneously inserted down into aligned sleeves 11 in an insulator 10 and the bandolier torn away to leave one individual contact in each sleeve.

Figure 6:
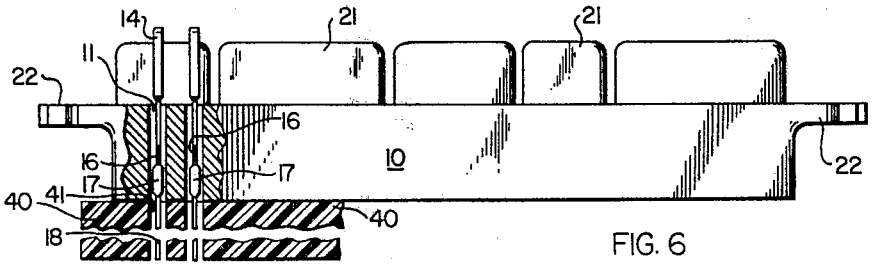
FIG. 6 is a side view of the insulator shown in FIG. 4.

As illustrated in the partially cut-away view of FIG. 6, the insulator 10 is first supported on the upper surface of a backup board 40 so that each sleeve 11 is positioned above and in vertical alignment with relatively large clearance holes 41 in the board 40. Each of the contacts 13 in a row are properly spaced from one another and the tails 18 of each of the contacts 13 are inserted into the top openings of the sleeves 11 so that all the contacts on the strip are inserted simultaneously. As the contacts 13 are inserted, the square portions thereof pass relatively freely down through the openings 12 while the shank portions 17 pass freely along the slots 19. The initially positioned row of contacts are separated from one another by removing the bandolier (not shown). Once the contacts 13 are positioned within the sleeves 11, they are held there primarily by light frictional interference between the inner walls of the sleeve 11 and the knurled portions 16 of the contacts. Contacts are similarly positioned in each of the other two rows of sleeves 11 in the insulator 10.

Next, an insulator 10, having rows of contacts 13 lightly supported in the sleeves 11 thereof, is positioned above a mounting substrate 24 with the tail portions 18 of each of the contacts 13 being received with clearance into aligned circular mounting apertures 25 in the substrate 24. As shown in FIG. 3, a seating tool 50 comprises an elongaged block of a durable material, such as steel, having a plurality of longitudinally extending grooves 51 and 52 formed thereon. The grooves 51 receive with clearance the top portions of the contacts 13 while the grooves 52 receive and clear the tops of the upstanding projections 21 of the insulator 10. A pair of contact shoulders 53 engage the upper shoulder of each contact while a seating surface 54 engages the upper outside edges of the insulator 10. The distance between the contact shoulders 53 and the seating surface 54 establishes the desired final height of the contact blades 14 above the upper insulator surface when the contacts have been finally press fitted into position in the receiving apertures of the mounting substrate 24.

Still referring to FIG. 3, when the tails 18 of the contacts 13 have been dropped through the receiving apertures 25, the seating tool 50 is placed over the upper surface of the insulator and contacts with the insulator projections 21 in the grooves 52 and the contact blades in the grooves 51. The tool 50 is placed beneath the ram 55 of a cylinder 56. When the cylinder 56 is operated to apply a downward force to the tool 50, the contact shoulders 53 force the contacts 13 to move downwardly through the sleeves 11 and press fit the shank portions into the apertures 25 in the mounting substrate 24. During press fitting, the seating surfaces 54 of the seating tool 50 serve as locating stops to very precisely position each one of the contact shanks 17 the desired distance into the mounting apertures 25 and at the same time locate each contact blade portion 14 the preferred distance above the insulator surface.

If the contacts 13 are initially inserted into the insulator sleeves 11 so that the contact shanks 17 protrude fully from beneath the insulator bottom, the pressing step serves to (a) first push the insulator fully onto the contacts 13 and (b) bottom out and press upon the tops of the contacts 13 in order to press fit the contact shanks 17 into the receiving apertures 25 in in the substrate 24. In this manner, the insulator 10 is still only lightly held to the contacts by the frictional engagement of each contact with the internal walls of the sleeve 11, in one embodiment with a force on the order of one to two pounds per contact position. The press fitted contacts, on the other hand, are retained in their mounting substrates by a force on the order of 20 to 40 pounds per contact position. Thus, any contact 13 can be removed by pulling downwardly on the tail portion 18 so as to pull it on through the aperture 25 in the substrate 24 or by pulling upwardly on the blade portion 14 to pull the contact 13 back up through the sleeve 11 in the insulator 10. Similarly, the insulator 10 may be removed from around the contacts by lifting upwardly while all of the contacts 13 remain firmly press fitted into the apertures 25 formed in the substrate 24.

In the connector of the present invention, the insulator 10 acts not as a structural member, but as a cover and holding fixture for press fitting the entire connector, including the contacts 13 held thereby, into a mounting substrate which serves as the primary structural member. The structure and method of the present invention enables an insulator to be completely loaded with lightly fitted contacts transported to a remote location, and there press fitted into apertures in a mounting substrate to form a structurally complete connector assembly.

Figure 10:
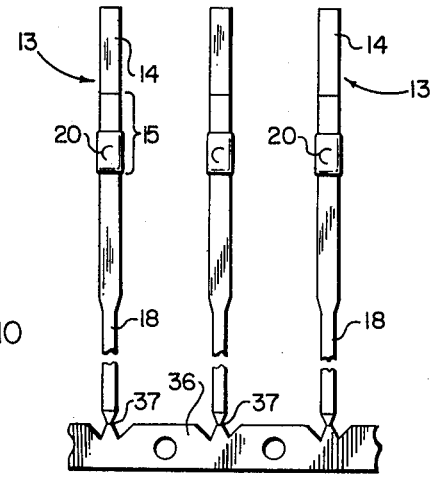
FIG. 10 is a front view of a plurality of contacts each having a tail portion attached to a common support strip and illustrative of an alternate embodiment of the contact support arrangement shown in FIG. 8.

An alternate embodiment of contacts and a support configuration which may be utilized for simultaneous contact insertion is shown in FIG. 10. The contacts are each formed as part of a common support strip 36 which is joined to the tail 18 of each contact by a narrow reduced section 37. This contact arrangement is especially adapted for formation at the same time the contacts are stamped from a strip of material by a progressive die. To provide a contact portion for light interfering engagement with the inner walls of an insulator sleeve 11, the intermediate portion 15 is provided with a slight deformation, such as a dimple 20.

Figure 11:
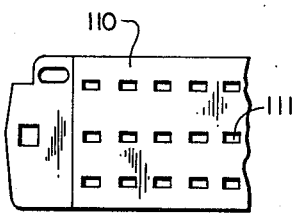
FIG. 11 is a partial view of an alternate embodiment of an insulator used with the contacts of FIG. 10.

With contacts formed having substantially the same width throughout their length, such as those of FIG. 10, an insulator 110 having rectangular sleeves 111 can be used, as shown in FIG. 11. The contacts are lightly held in place within the sleeves 111 by a slight interference between the inner walls of the sleeves 111 and the deformation 20 in the intermediate portion 15 of the contact (FIG. 10).

Having described the invention in connection with certain specific embodiments thereof, it is to be understood that further modifications may now suggest themselves to those skilled in the art and it is intended to cover such modifications as fall within the scope of the appended claims.

What is claimed is:

1. A method of assembling an electrical connector which includes an insulative block having a plurality of sleeves formed therethrough by affixing the insulative block to a substrate by means of contacts extending through and frictionally engaging the walls of said sleeves, said method comprising:

inserting contacts through the sleeves in said insulative block, said contacts being retained within the sleeves by frictional engagement with the inner walls thereof;

guiding the portions of said contacts protruding from beneath the insulative block into aligned receiving apertures in a mounting substrate; and press fitting said contacts into the apertures in said mounting substrate to rigidly secure said contacts to said substrate and permit said insulative block to be readily removed from said contacts for access thereto by applying an upward force to overcome the frictional engagement between said contacts and the inner walls of the sleeves through said insulative block.

2. A method of assembling an electrical connector as set forth in claim 1 wherein said contacts are mounted extending transversely on a common support strip a spaced distance from one another and wherein said inserting step includes:

severing said common support strip to separate a row of contacts on a strip from the rest;

simultaneously moving all of the contacts in the row through the sleeves in the insulative block until the contacts are frictionally retained within the sleeves; and removing the common support strip to separate the inserted contacts from one another.

3. A method of assembling an electrical connector as set forth in claim 2 wherein said common support strip cpmprises a bandolier having fragile tines which grip each one of the contacts mounted therealong.

4. A method of assembling an electrical connector as set forth in claim 2 wherein said common support strip comprises a transverse strip of metal extending along the tops of the contacts and joined thereto by a narrow reduced section.

5. A method of assembling an electrical connector as set forth in claim 1 wherein said press fitting step comprises:

applying pressure to an upper portion of the contacts to rigidly mount them into the receiving apertures in the substrate; and moving the contacts relative to the insulative block sleeves to position the upper portions of the contacts a selected distance above the upper surface of the insulative block.

* * * * *